United States Patent [19]

Armelin

[11] Patent Number: 4,479,434

[45] Date of Patent: Oct. 30, 1984

[54] INK FOUNTAIN, INCORPORATING INDIVIDUALLY REGULATED METERING SEGMENTS, FOR A PRINTING MACHINE

[75] Inventor: Michel Armelin, Londres, England

[73] Assignee: Societe anonyme dite: Machines Chambon, Orleans, France

[21] Appl. No.: 577,486

[22] Filed: Feb. 6, 1984

[30] Foreign Application Priority Data

Feb. 8, 1983 [FR] France ..... 83 01945

[51] Int. Cl.[3] ..... B41F 31/04; B41L 27/06

[52] U.S. Cl. ..... 101/365

[58] Field of Search ..... 101/365, 350, 351, 363, 101/352, 148, 207, 208-210; 118/261; 15/256.51

[56] References Cited

U.S. PATENT DOCUMENTS

| | | | |
|---|---|---|---|
| 3,456,585 | 7/1969 | Brodie | 101/365 |
| 4,058,058 | 11/1977 | Hantscho | 101/365 |
| 4,318,341 | 3/1982 | Pietsch | 101/365 |
| 4,350,095 | 9/1982 | Simeth | 101/365 |

FOREIGN PATENT DOCUMENTS

| | | | |
|---|---|---|---|
| 2389487 | 12/1978 | France | 101/365 |
| 2471863 | 12/1980 | France | 31/4 |

*Primary Examiner*—J. Reed Fisher

*Attorney, Agent, or Firm*—Sandler & Greenblum

[57] ABSTRACT

An ink fountain, incorporating individually regulated metering segments, for a printing machine, comprises a vat containing ink and delimited, on one side, by a horizontal inking roller. The upper edges of the metering segments determine, with the peripheral surface of the inking roller, gaps of widths adjustable as a function of the thickness of the film of ink having to be formed on the inking roller. Regulating pusher elements are mounted to slide in a body and act respectively, at their ends, on the upper parts of the individual metering segments. Each metering segment is fixed on a front face of a common support block itself removably mounted on the body, this block being pierced, in its upper part, with holes through which extend the pusher elements acting on the segments and adapted to be dismantled jointly with segments which it bears.

10 Claims, 7 Drawing Figures

INK FOUNTAIN, INCORPORATING INDIVIDUALLY REGULATED METERING SEGMENTS, FOR A PRINTING MACHINE

BACKGROUND OF THE INVENTION

The present invention relates to an ink fountain, incorporating individually regulated metering segments, for a printing machine.

Inking fountains for a printing machine are already known which comprise a vat containing ink, this vat being delimited, on one side, by a horizontal inking roller driven in rotation, on the opposite side, by a body extending parallel to the inking roller, and lateraly, by two vertical cheeks. The body bears, in the immediate proximity of the peripheral surface of the inking roller, a doctor blade parallel to the inking roller and which is formed by a succession of metering segments adjacent one another and of which the upper edges extend parallel to the inking roller at a short distance from the peripheral surface thereof, this distance being able to be adjusted individually for each metering segment. These metering segments are fixed to the body, at their lower parts, by means of screws and they are actuated individually by pusher elements extending through the body and which are controlled, for example, by regulating levers or motorized assemblies. It is thus possible, with the aid of thesepusher elements, to place the upper part of each individual metering segment more or less close to the peripheral surface of the inking roller and thus to adjust the thickness of the film of ink passing between the upper edge of the metering segment in question and the peripheral surface of the inking roller. Such an ink fountain is described for example in French Patent Application No. 2 471 863.

Ink fountains of this type present a certain number of drawbacks, particularly from the point of view of maintenance and replacement of the metering segments. In fact, when it is necessary to dismantle the ink fountain, to change the metering segments for example, the whole of the ink fountain must effectively be dismantled in order to have access to the metering segments. Furthermore, a change of these segments necessarily involves new adjustments of the pusher elements controlling the individual segments.

SUMMARY OF THE INVENTION

It is an object of the present invention to overcome these drawbacks by providing an ink fountain of particularly simple design which enables the segments to be changed easily and rapidly.

To this end, this ink fountain, incorporating individually regulated metering segment, for a printing machine, comprising a vat containing ink and delimited, on one side, by a horizontal inking roller and, on the other side, by a transversely extending body, as well as by two vertical, lateral cheeks, the body of the ink fountain bearing, in the vicinity of the peripheral surface of the inking roller, a series of metering segment aligned in parallel to the inking roller, and of which the upper edges determine, with the peripheral surface of the inking roller, gaps of widths adjustable as a function of the thickness of the film of ink having to be formed on the inking roller, downstream of each metering segment, and regulating pusher elements mounted to slide in the body, and acting respectively, at their ends, on the upper parts of the individual metering segments, is characterized in that each metering segment is fixed on a front face of a common support block itself removably mounted on the body, this block being pierced, in its upper part, with holes through which extend the pusher elements acting on the segments and adapted to be dismantled jointly with segments which it bears.

The ink fountain according to the invention offers the advantage that, when it is desired to clean, change or set right the metering segments, it suffices to dismantle the common support block as a whole which may then be remounted on the body of the ink fountain, without it being necessary to remake the adjustments of the positions of the pusher elements acting on the metering segments. Furthermore, as all the individual segments are mounted in common on the same support, constituting an assembly which is inexpensive to manufacture and which is recoverable, the ink fountain according to the invention also makes it possible to mount it without clearance between segments as it is then possible to machine the assembly both lengthwise and heightwise, to bring all the segments to the desired length, and this whatever the tolerances of the individual segments, provided, of course, that the variations in dimensions are not great.

In its upper part, the common support block is housed beneath a plate constituting the bottom of the ink fountain and at that spot tightness is ensured either by direct contact between the upper edge of each metering segment and a lower end face of this bottom, or by the provision of a deformable blade fixed on the upper face of the block and extending above the individual metering segments.

BRIEF DESCRIPTION OF THE DRAWINGS

The invention will be more readily understood on reading the following description with reference to the accompanying drawings, in which.

DESCRIPTION OF THE PREFERRED EMBODIMENTS

Figure 1:
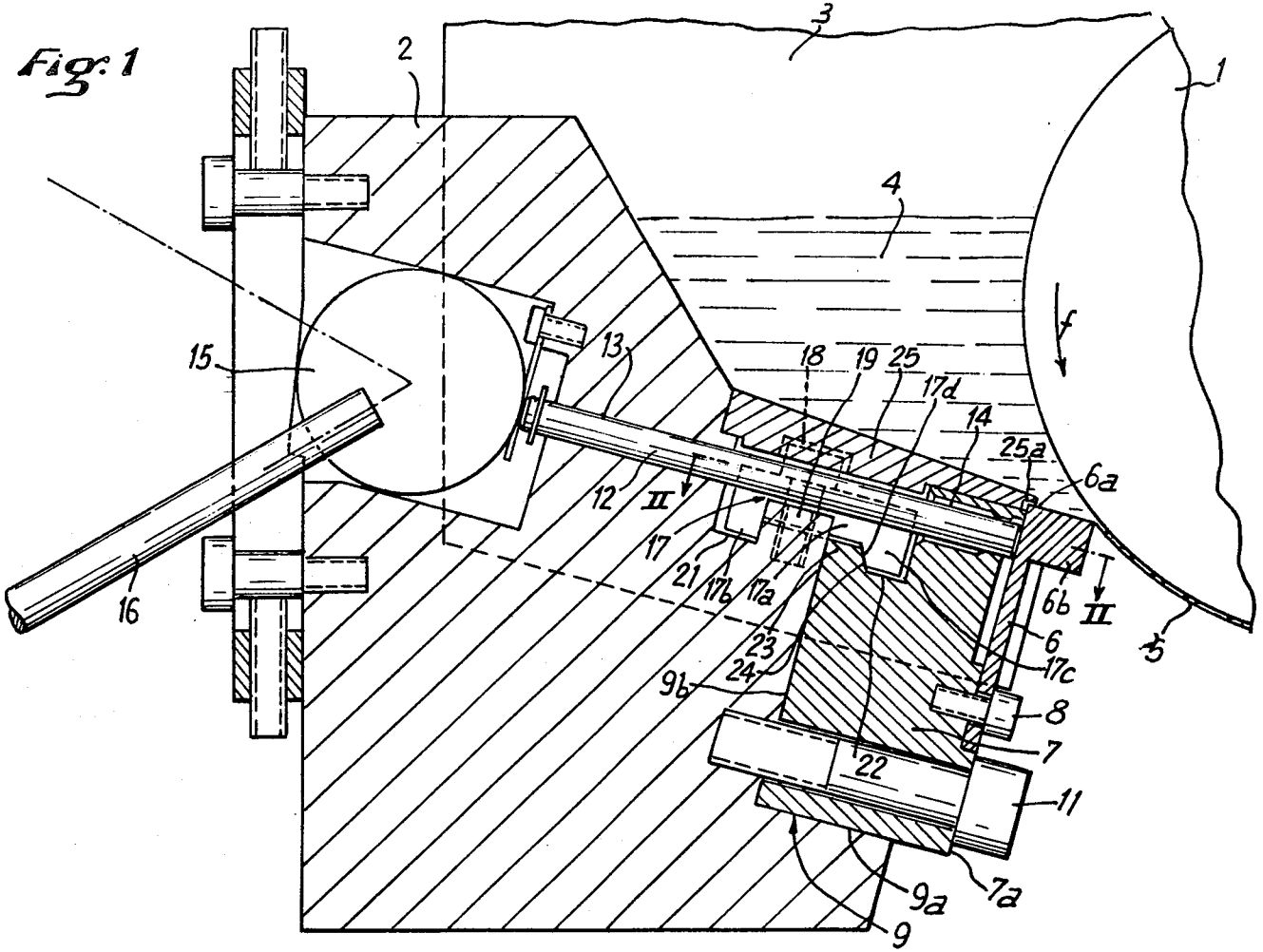
FIG. 1 is a view in vertical section perpendicular to the axis of the inking roller.
Figure 2:
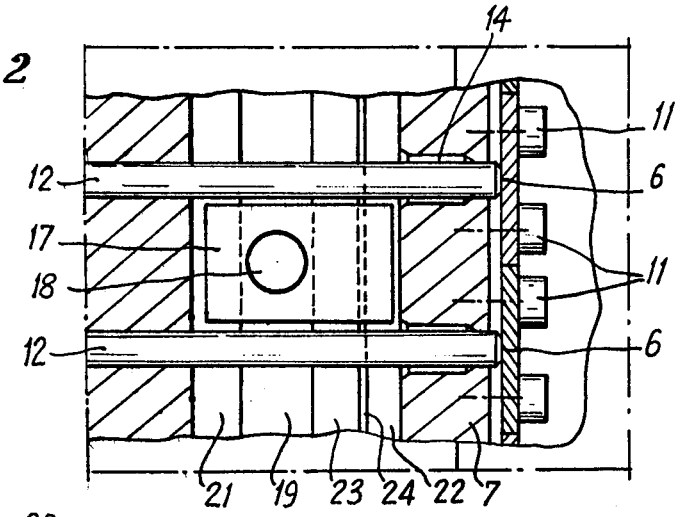
FIG. 2 is a view in section along line II—II of FIG. 1.

Referring now to the drawings, the ink fountain according to the invention comprises an inking roller 1 driven in rotation in the direction of arrow f, i.e. in anti-clockwise direction, a body 2 extending parallel to the axis of the roller 1 and two lateral, vertical cheeks 3. The roller 1, the body 2 and the cheeks 3 constitute a vat containing a reservoir 4 of ink adapted to form, on the peripheral surface of the inking roller 1, a film 5 of adjustable thickness.

For adjusting the thickness of the film 5, the ink fountain comprises a succession of individual metering segments 6 which are substantially coplanar and are juxtaposed with respect to one another in a direction parallel to the axis of the inking roller 1, forming to some extent a doctor blade. Each of these individual metering segments 6 is constituted by a plate which is fixed on a common support block 7, by means of screws 8 passing through holes made in the metering segments 6 and screwed in tapped holes provided in the front face 7*a* of the support block 7. Each metering segment 6 presents, in its upper part, a protuberance 6*b* in the direction of the inking roller.

The support block 7 is in parallelepipedic form and it is fixed on the body 2 and more particularly in a rabbet 9 thereof, by means of screws 11. The rabbet 9 comprises a lower bearing face 9*a* and a perpendicular front face 9*b* against which the support block 7 is applied.

Each of the metering segments 6 forms to some extent a flexible blade fixed at its lower end (or elsewhere) and its mobile upper part, which is close to the peripheral surface of the inking roller 1, is actuated by an adjusting pusher element 12. Each pusher element 12 is mounted to slide in a hole 13 pierced in the body 2 and in coaxial hole 14 pierced in the upper part of the common support block 7. The pusher element 12 projects outwardly with respect to the hole 14 and it abuts at that spot, by its end, against the inner face of the segment 6, i.e. the face turned towards the support block 7. The other end of the pusher element 12 is actuated in translation either by an adjusting eccentric 15 which may be driven in rotation, in manner known per se, by a lever 16 for example, or by any other manual or motorized means. Rotation of the eccentric 15, in one direction or in the other, consequently provokes a movement of axial slide of the pusher element 12 which thus pushes the individual metering segment 6 with which it is associated, more or less in the direction of the inking roller 1. In this way, it is possible to adjust the gap delimited between the upper edge 6*a* of the individual segment 6 and the peripheral surface of the inking roller 1, and consequently to adjust the thickness of the film of ink 5.

In its upper part, the support block 7 is maintained applied against the front face 9*b* of the rabbet 9 of the body 2 by means of C-shaped straps 17. Each of these traps 17 comprises a web 17*a* which is tightened by means of a screw 18 screwed perpendicularly in a shoulder 19 formed in the body 2, between the front face 9*a* of the rabbet 9 and a groove 21 formed in the body 2, opening into the upper face thereof and extending parallel to the front face 9*b*. The C-shaped strap 17 presents a first branch 17*b*, facing downwardly, which is engaged and abuts in the groove 21. It also comprises a second, downwardly turned branch 17*c* which is engaged in a groove 22 made in the common support block 7 and more particularly in the angle of a rabbet provided in the upper left-hand part thereof. This groove 22 defines, with the outer face of the block 7 which is applied against the front face 9*b*, a shoulder 23 to which it is connected by an inclined face 24. In the same way, the branch 17*c* of the strap 17 is connected to its web 17*a* by an inclined ramp 17*d* with the same slope as the inclined face 24, in order to absorb the effort due to the curvature of the segments by the pusher elements 12. It is therefore seen that, when each strap 17 is tightened by means of the screw 18, the cooperation of the inclined faces 17*d* and 23 provokes a tightening of the support block 7 against the front face 9*b* of the rabbet 9.

The assembly composed of the pusher elements 13, the block 7 and the metering segments 6 is covered, in its upper art, by a plate 25 constituting the bottom of the ink fountain and extending over the whole width thereof. This bottom 25 is fixed to the body 2 by means of screws (not shown), and which preferably pass through holes pierced right through the body, of which the heads are housed in the lower part of the body and the threaded parts are engaged in tapped holes provided in the lower face of the bottom 25. This bottom 25 presents, at its end close to the inking roller 1, a downwardly open rabbet 25*a* which caps the upper edges 6*a* of the individual metering segments 6. A perfect seal is thus obtained between each metering segment 6 and the bottom 25 of the ink fountain, which avoids ink penetrating inside the block 7 and in particular in the holes 14 through which the pusher elements 13 pass.

Figure 3:
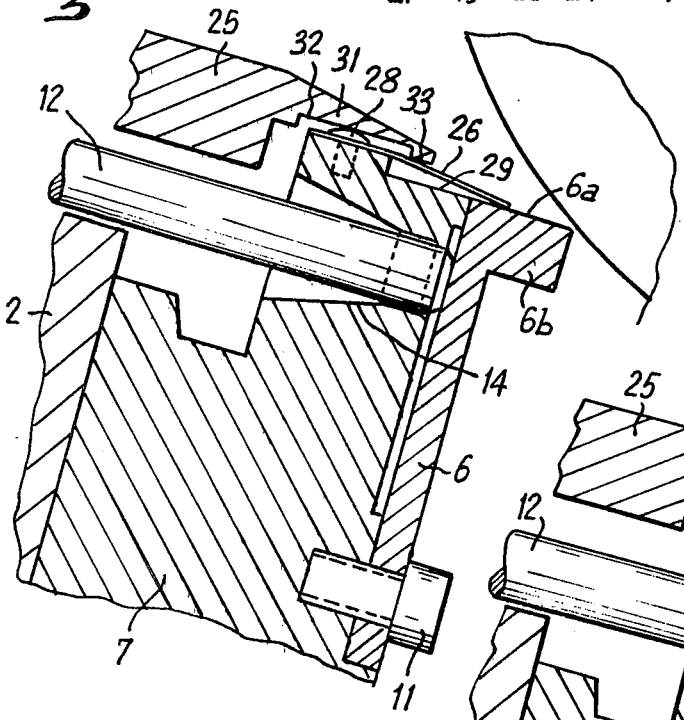
FIG. 3 is a partial view in vertical section on a larger scale of the upper part of the common support block, according to a variant embodiment, this support block being shown fixed on the body of the ink fountain.
Figure 4:
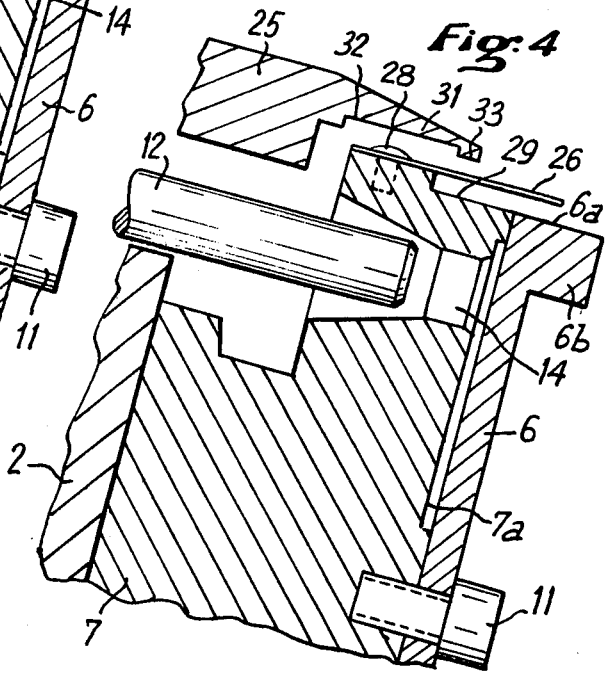
FIG. 4 is a view in section similar to that of FIG. 3, the common support block being shown spaced apart from the bottom of the ink fountain.

According to a variant embodiment, tightness is obtained, as shown in FIGS. 3 and 4, by means of a deformable elastic blade 26 which is fixed on the upper face of the support block 7 by means of screws or rivets 28. This blade 26 normally extendss, at rest, above all the metering segments 6 and at a certain distance from the upper edges 6*a* thereof, due to the provision of a rabbet 29 in the upper right angle of the support block 7. For its part, the bottom 25 is extended in the direction of the inking roller 1 by a projecting lip 31 which presents, on its lower face, a groove 32 defining, at the end of the lip 31, a downwardly turned shoulder 33.

For assembly, the common support block 7, on which are mounted all the individual metering segments 6 and the blade 26, is fixed on the body 2 then the plate 25 constituting the bottom of the ink fountain is fixed on body 2. The screws or rivets 28 ensuring fixation of the blade 26 then come into engagement in the groove 32 of the lip 31 and the shoulder 33 pushes the flexible blade 26 downwardly. Consequently, as may be better seen in FIG. 3, the blade 26 is incurved and pusshed downwardly so that its end abuts on the upper edges 6*a* of the associated metering segments 6. Consequently, when each of these edges 6*a* is more or less spaced apart from the front face 7*a* of block 7, the blade 26 which scrapes on the edge 6*a* opposes any penetration of ink inside the block 7.

As has been seen previously, each of the segments 6 presents, in its upper part, a protuberance 6*a* extending in the direction of the inking roller. This protuberance is provided to separate the zone where tightness is effected as much as possible from the zone where the film of ink 5 is rolled. In fact, in this latter zone, a very high pressure prevails and, to reduce the risks of leakage towards the inside of the block 7, it is preferable to place the means ensuring tightness in a zone where the pressure of the ink is lower.

The above arrangement is, however, not limiting. Other variant embodiments might be imagined, such as for example the one comprising segments 6 of larger thickness, in a sufficiently flexible and elastic material to enable the upper end of each segment 6 to be brought more or less closer to the peripheral surface of the inking roller 1.

Figure 5:
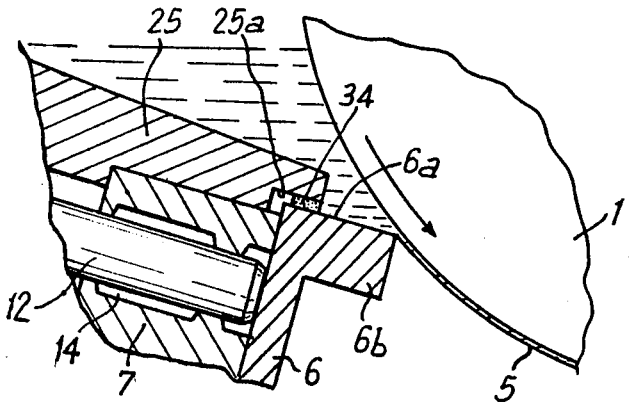
FIG. 5 is a partial view in vertical section, on a larger scale, of a variant embodiment of the device ensuring tightness at the location of the upper edges of the segments.

In the variant embodiment illustrated in FIG. 5, tightness is reinforced due to the provision, in the rabbet 25*a*, of a sealing member 34 made of an appropriate deformable material. This sealing member is compressed by the upper edge 6*a* of each segment 6 and tightness is thus improved at that spot.

Figure 6:
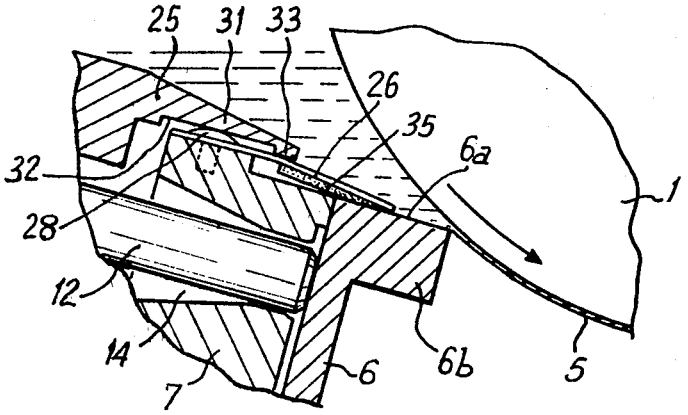
FIG. 6 is a partial view in vertical section of another variant embodiment of the device ensuring tightness at the location of the upper edges of the segments.
Figure 7:
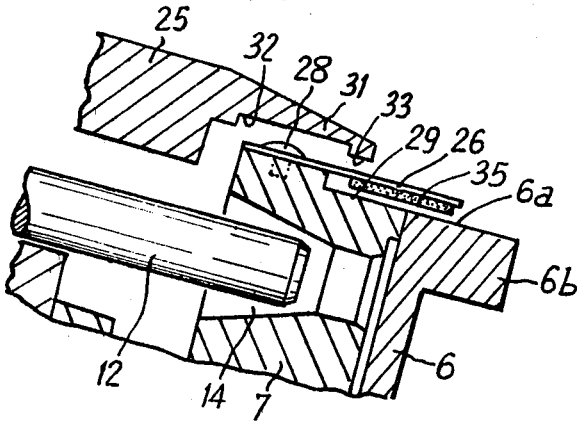
FIG. 7 is a partial view in vertical section of the device of FIG. 6, before the plate constituting the bottom of the ink fountain has been positioned.

In the embodiment illustrated in FIGS. 6 and 7, which corresponds to a variant of the one shown in FIGS. 3 and 4, the flexible blade 26 presents, on its lower face, a seal 35 made of deformable material, by which it abuts on the upper edges 6*a* of the individual segments 6 when it is pushed downwardly as shown in FIG. 6. This seal 35 contributes to improving tightness mainly in the zones where the individual segments 6 are juxtaposed.

What is claimed is:

1. An ink fountain, incorporating individually regulated metering segment, for a printing machine, comprising a vat containing ink and delimited, on one side, by a horizontal inking roller and, on the other side, by a transversely extending body, as well as by two vertical, lateral cheeks, the body of the ink fountain bearing, in the vicinity of the peripheral surface of the inking roller, a series of metering segment aligned in parallel to the inking roller, and of which the upper edges determine, with the peripheral surface of the inking roller, gaps of widths adjustable as a function of the thickness of the film of ink having to be formed on the inking roller, downstream of each metering segment, and regulating pusher elements mounted to slide in the body, and acting respectively, at their ends, on the upper parts of the individual metering segments, wherein each metering segment is fixed on a front face of a common support block itself removably mounted on the body, this block being pierced, in its upper part, with holes through which extend the pusher elements acting on the segments and adapted to be dismantled jointly with segments which it bears.

2. An ink fountain according to claim 1, wherein the common support block is parallelepipedic in form.

3. An ink fountain according to claim 2, wherein the common support block is removably mounted in a rabbet of the body, this rabbet comprising a lower bearing face and a front perpendicular face against which the support block is applied.

4. An ink fountain according to claim 3, wherein the support block is maintained applied against the inclined front face of the rabbet of the body by means of C-shaped straps, each of these straps comprising a web which is tightened by means of a screw screwed perpendicularly in a shoulder formed in the body, between the front face of the rabbet and a groove formed in the body, opening in the upper face therof and extending parallel to the front face, each strap further presenting a first branch turned downwardly, which is engaged and abuts in the groove in the body, and a second outer branch, turned downwardly and which is engaged in a groove made in the common support block and more particularly in the angle of a rabbet provided therein, this latter groove delimiting, with the outer face of the block which is applied against the front face, a shoulder to which it is connected by an inclined face, the second outer branch of the strap being connected to its web by an inclined ramp of the same slope as the inclined face.

5. An ink fountain according to claim 1, wherein the assembly formed by the pusher elements, the common support block and the metering segments is covered, in its upper part, by a plate constituting the bottom of the ink fountain and extending over the whole width thereof, this plate constituting the bottom being fixed to the body by means of screws.

6. An ink fountain according to claim 5, wherein the plate forming the bottom presents, at its end close to the inking roller, a downwardly open rabbet which is in contact with the upper edges of the individual metering segments.

7. An ink fountain according to claim 6, wherein the rabbet bears a sealing member which is in contact with the upper edges of the individual metering segments.

8. An ink fountain according to claim 5, wherein the plate forming the inking roller is extended in the direction of the inking roller, by a projecting lip which presents, on its lower face, a groove defining, at the end of the lip, a downwardly directed shoulder, and a deformable elastic blade is fixed on the upper face of the common support block, this blade extending normally, at rest, above the metering segments and at a certain distance from the upper edges therof, due to the provision of a rabbet in the upper angle of the support block, so that, when the plate constituting the bottom of the ink fountain is applied against the body and the common support block which is fixed thereto, the shoulder of the lip pushes the flexible blade downwardly and this blade abuts, by its end, on the upper edge of the associated metering segment, thus ensuring tightness.

9. An ink fountain according to claim 8, wherein the flexible blade bears, on its lower face, a seal made of deformable material, by which it abuts on the upper edges of the segments.

10. An ink fountain according to claim 1, wherein each of the individual metering segments presents, in its upper part, a protuberance directed towards the inking roller.

* * * * *